US005564781A

United States Patent [19]

Pine

[11] Patent Number: 5,564,781

[45] Date of Patent: Oct. 15, 1996

[54] BASE FRAME FOR BASE ASSEMBLY OF ROCKER RECLINER CHAIR

[75] Inventor: James J. Pine, Tupelo, Miss.

[73] Assignee: JPD Incorporated, Tupelo, Miss.

[21] Appl. No.: 381,287

[22] Filed: Jan. 31, 1995

Related U.S. Application Data

[63] Continuation-in-part of Ser. No. 257,164, Jun. 9, 1994, abandoned.

[51] Int. Cl.[6] ..... A47C 3/027

[52] U.S. Cl. ..... 297/267.1; 297/261.1; 297/DIG. 7; 248/188.1; 248/346.01

[58] Field of Search ..... 297/267.1, 266.1, 297/265.1, 261.1, 264.1, DIG. 7; 248/188.1, 346.01

[56] References Cited

U.S. PATENT DOCUMENTS

| | | | |
|---|---|---|---|
| 1,789,280 | 1/1931 | Armstrong | 248/346 X |
| 2,244,614 | 6/1941 | Fox | 297/267 |
| 2,813,574 | 5/1955 | Hawkins | 297/267 |
| 2,963,077 | 4/1959 | Knabusch et al. | 297/265 |
| 3,190,693 | 6/1965 | Underdown . | |
| 3,462,190 | 8/1969 | Campbell | 297/265 |
| 3,476,342 | 11/1969 | Motl et al. | 248/188.1 X |
| 3,502,370 | 3/1970 | Pommellet | 248/624 X |
| 3,881,713 | 5/1975 | Joyce . | |
| 4,128,273 | 12/1978 | Jones | 297/265 |
| 4,140,342 | 2/1979 | Jones . | |
| 4,810,032 | 3/1989 | Gibson | 297/261 |
| 4,844,541 | 7/1989 | Laird | 297/265 |

FOREIGN PATENT DOCUMENTS 2031111 12/1971 Germany .

*Primary Examiner*—Peter M. Cuomo
*Assistant Examiner*—Anthony D. Barfield
*Attorney, Agent, or Firm*—Watson Cole Stevens Davis, P.L.L.C.

[57] ABSTRACT

A base frame for a base assembly that supports a linkage support mechanism of a rocker-recliner chair includes metal side runners and metal end rails, the side runners having a generally Z-shaped cross sections and the end rails extending between and covering corresponding ends of the side runners. Upper flanges of the end rails are connected, e.g., bolted, to upper flanges of the side runners and lower flanges of the end rails are connected to lower flanges of the side runners to provide a rigid structure whose four corners are locked and display excellent squareness.

8 Claims, 2 Drawing Sheets

15
10
4
50
16
50
41
3
3
20
24
23
4
18
44
43
19
5
33
30
34
42
40
2
50
17
50
2
5

M2
17
17a
42e
36
36
42d
70
70

BASE FRAME FOR BASE ASSEMBLY OF ROCKER RECLINER CHAIR

CROSS-REFERENCE TO RELATED APPLICATION

This is a continuation-in-part of application Ser. No. 08/257,164, filed Jun. 9, 1994, now abandoned.

BACKGROUND OF THE INVENTION

FIELD OF THE INVENTION

The present invention relates to base assemblies used to support the linkage support mechanisms of rocker-recliner chairs, and more particularly to the base frames of such base assemblies.

THE PRIOR ART

Conventional base frames used in base assemblies that support the linkage support mechanisms of rocker-recliner chairs are made of hardwood side runners connected together by hardwood cross rails, the cross rails being connected to the side runners by doweling, gluing and the use of stapled corner cleats. However, such base frames can break apart if dropped, which will cause great inconvenience and unwanted repair costs to fix. In addition, these base frames require the use of eight separate pieces of hardwood, requiring significant time and expense to construct and properly connect together, and indeed good hardwood is becoming more and more difficult to find. Also, such wood base frames, in order to be aesthetically pleasing (they can be seen beneath the lower portion of the chair), must be stained, and these stains can leach out when the flooring surface around the wood base frame is cleaned. Finally, the wood base frame will display sharp edges and the wood thereof can produce splinters in the hands and feet of anyone handling the base frame.

It is an object of the present invention to provide a base frame for a base assembly used to support a linkage support mechanism of a rocker-recliner chair which will be simple in construction, extremely strong, which will have smooth corners (no sharp edges) and which will be aesthetically attractive.

SUMMARY OF THE INVENTION

According to the present invention the base frame is made of side runners and end rails, the side runners being identical and defining a generally Z-shaped cross section, and the end rails being identical and constructed to extend between and cover corresponding ends of the side runners, the end rails being connected to the side runners so as to provide a very rigid structure which is nevertheless aesthetically attractive. The side runners include upper and lower flanges and center webs which, at opposite ends of the side runners, are advantageously inclined relative to the upper and lower flanges, and the end rails include upper and lower flanges and center webs which are inclined relative to the upper and lower flanges at an inclination which corresponds to that of the center webs of the side runners. The side runners and end rails can be made of wood, but are preferably made of metal.

Further features and advantages of the invention will be understood by reference to the accompanying drawings and the following discussion.

DETAILED DESCRIPTION OF THE PREFERRED EMBODIMENT

Figure 1:
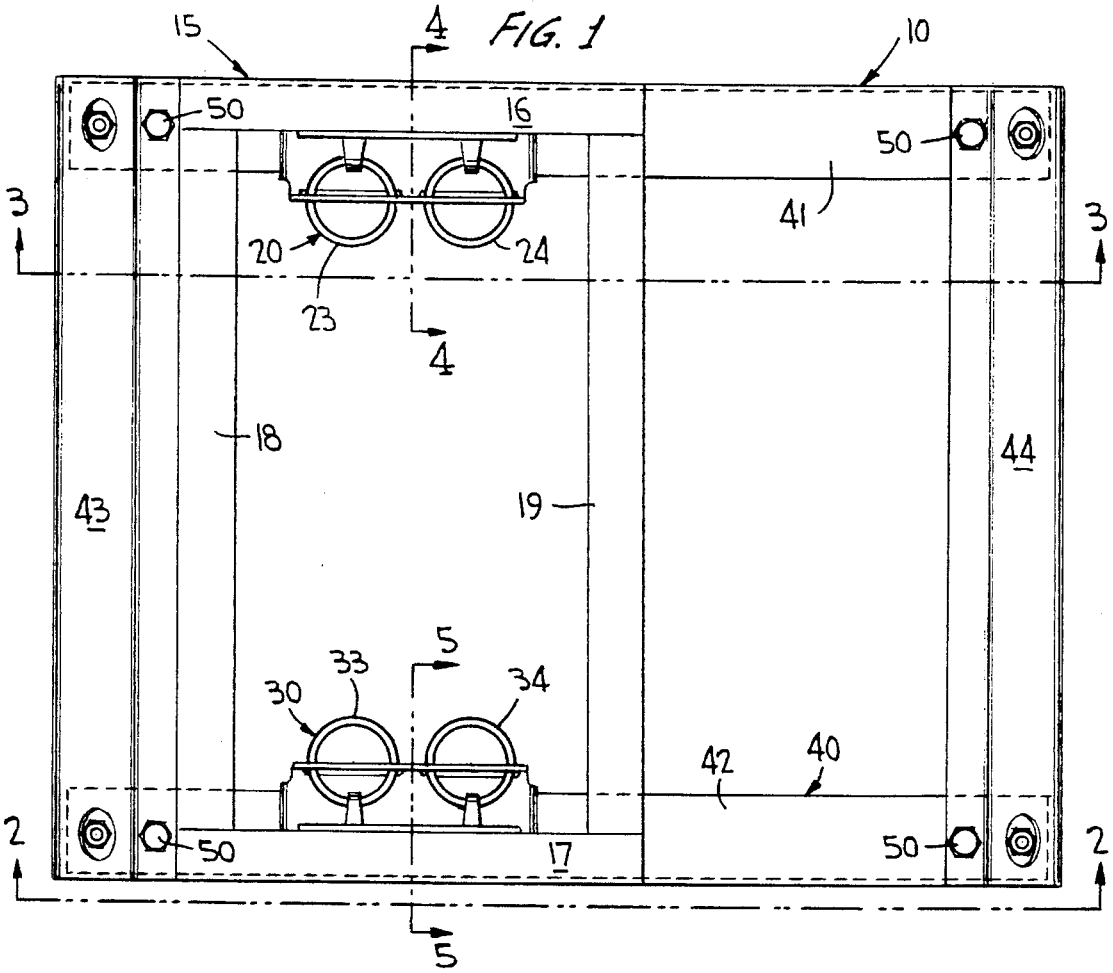
FIG. 1 is a plan view of a base assembly for a rocker-recliner chair containing a base frame according to a preferred embodiment of the present invention.

A base assembly 10 for a rocker-recliner chair which includes a base frame according to the present invention is depicted in FIGS. 1–5. It includes a conventional cam assembly 15 and conventional spring assemblies 20, 30, which mount the cam assembly above the inventive base frame 40. The cam assembly 15 includes hardwood cam elements 16, 17 which have arcuate lower surfaces 16*a*, 17*a*, and hardwood cross struts 18, 19 which are connected at their opposite ends to inner (facing) surfaces of the cam elements, i.e., at opposite forward and rearward ends thereof, by doweling and/or gluing and the use of stapled corner blocks, thus providing a rigid structure. The spring assemblies 20, 30 are identical and include lower brackets 21, 31 having an L-shaped cross section, upper brackets 22, 32 having a generally L-shaped cross section, and coil springs 23, 24, 33, 34 respectively connected therebetween. The lower brackets 21, 31 are attached to an inner surface of respective side runners of the base frame (to be described below), and the upper brackets 22, 32 are attached by wood screws 25, 35 to an inner surface of the respective cam elements 16, 17, such that the coil springs 23, 24, 33, 34 are in a stretched condition. Mounting rails M1, M2 of a supported linkage support mechanism of the rocker-recliner chair can be respectively connected to the outer sides of the cam elements 16, 17 by suitable bolts.

Figure 2:
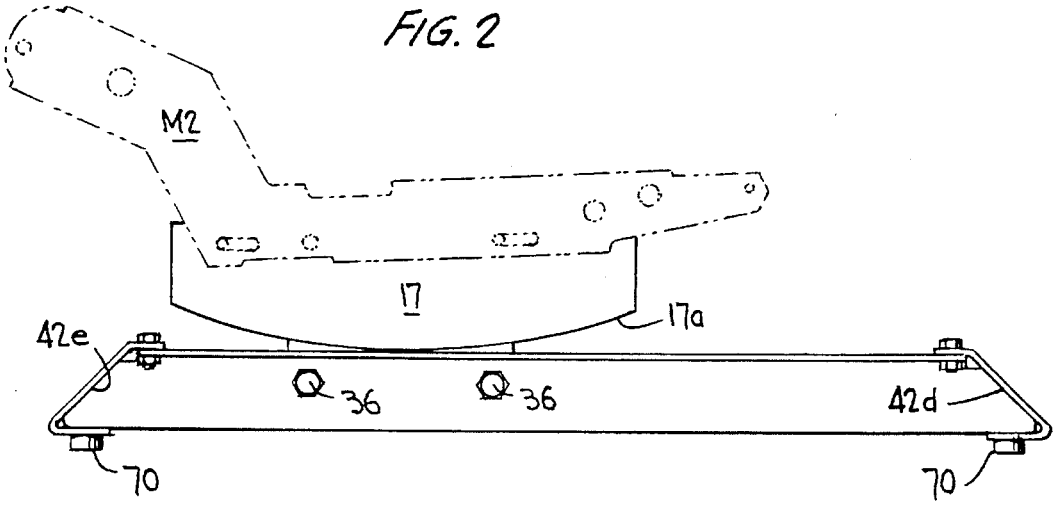
FIG. 2 is an elevational side view of the base assembly of FIG. 1 as seen along line 2—2.
Figure 3:
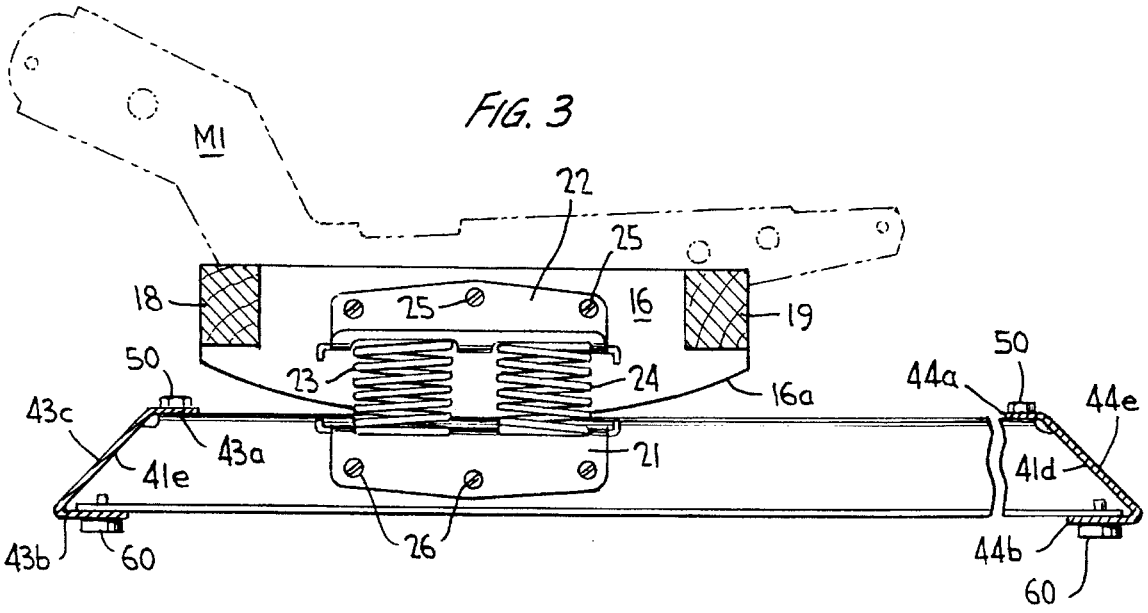
FIG. 3 is a sectional view of the base assembly of FIG. 1 as seen along line 3—3.
Figure 4:
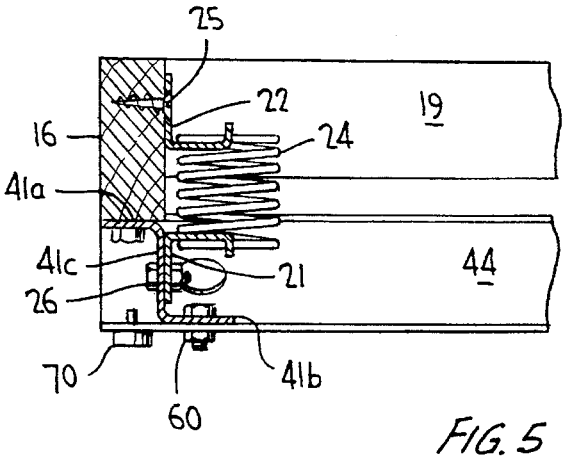
FIG. 4 is a sectional view of the base assembly of FIG. 1 as seen along line 4—4.
Figure 5:
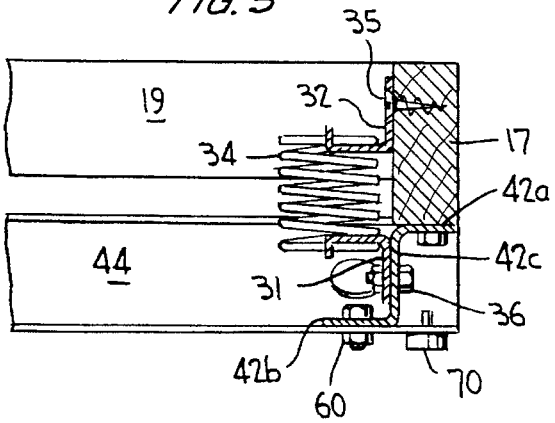
FIG. 5 is a sectional view of the base assembly of FIG. 1 as seen along line 5—5.

The inventive base frame 40 includes identical metal side runners 41, 42 and identical metal end rails 43, 44. As seen in FIGS. 4 and 5, the side runners have generally Z-shaped cross sections and define upper flanges 41*a*, 42*a*, lower flanges 41*b*, 42*b* and center webs 41*c*, 42*c* extending between the upper and lower flanges. The lower brackets of the spring assemblies are respectively connected by bolts 26, 36 to inside surfaces of the center webs 41*c*, 42*c* (so that the arcuate lower surfaces 16*a*, 17*a* of the cam elements 16, 17 will contact the upper flanges 41*a*, 42*a*). As best shown in FIGS. 2 and 3, the lower flanges of the side runners are longer in length than the upper flanges thereof, and the center webs provide inclined end edge portions 41*d*, 41*e*, 42*d*, 42*e* at their opposite ends.

The end rails 43, 44 define top flanges 43*a*, 44*a*, bottom flanges 43*b*, 44*b*, and inclined center webs 43*c*, 44*c*, the inclination of the center webs 43*c*, 44*c* corresponding with the inclination of the end edges 41*e*, 42*e*, 41*d*, 42*d* of the center flanges of the side runners 41, 42. The end rails cover the ends of the side runners as indicated in FIGS. 1, 2 and 3 and are connected thereto by bolts 50 which connect the top flanges of the end rails to the top flanges of the side runners and bolts 60 which connect the bottom flanges of the end rails to the bottom flanges of the side runners, thus providing a very rigid structure. Such connections lock the four corners of the base frame together and provide excellent squareness, and the shaping of both the side runners and the end rails provides the base frame with smooth corners (no sharp edges). Pads 70 are connected to the lower surfaces of the bottom flanges of the end rails 43, 44 (at their opposite ends) to support the base frame on a flooring surface.

Although a specific embodiment of the inventive base frame has been shown and described, various modifications can be made therein and still fall within the scope of the appended claims. For example, instead of using bolts 50, 60 to connect the end rails to the side runners, rivets can be used, or the metal members can be connected by other known sheet metal joining techniques. Also, the side runners and end rails can be made of wood.

I claim:

1. A base frame for a base assembly used to support a linkage support mechanism for a rocker-recliner chair, said base frame comprising:

two identical side runners which each define a generally Z-shaped cross section and provide an upper flange, a lower flange and a center web, said side runners defining opposite first and second ends, two identical end rails which each define an upper flange, a lower flange and a center web, one of said end rails extending between and covering corresponding first ends of said side runners and a second of said end rails extending between and covering corresponding second ends of said side runners, and connecting means connecting said one end rail to said first ends of said two side runners and connecting said second end rail to said second ends of said two side runners.

2. A base frame according to claim 1, wherein the lower flange of each of said side runners is longer in length than the upper flange thereof and wherein the center web of each of said side runners defines an inclined edge portion at its opposite ends.

3. A base frame according to claim 2, wherein the center web of each of said end rails is inclined relative to the upper and lower flanges thereof, the inclination corresponding to the inclination of the inclined edge portions of the center webs of said side runners.

4. A base frame according to claim 1, wherein said connecting means consist of bolts.

5. A base frame according to claim 1, wherein said side runners and end rails are made of metal.

6. A base frame according to claim 1, wherein said side runners and end rails are made of wood.

7. A base frame assembly according to claim 5, wherein said side runners and end rails are made of metal.

8. A base assembly for supporting a linkage support mechanism of a rocker-recliner chair, said base assembly including a cam assembly, a base frame and two spring assemblies which support the cam assembly above the base frame, wherein the base frame comprises:

two identical side runners which each define a generally Z-shaped cross section and provide an upper flange, a lower flange and a center web, said side runners defining opposite first and second ends, two identical end rails which each define an upper flange, a lower flange and a center web, one of said end rails extending between and covering corresponding first ends of said side runners and a second of said end rails extending between and covering corresponding second ends of said side runners, and connecting means connecting said one end rail to said first ends of said two side runners and connecting said second end rail to said second ends of said two side runners.

* * * * *